United States Patent [19]

Chorey et al.

[11] 4,262,491

[45] Apr. 21, 1981

[54] ELECTRONIC MODULATING SYSTEM FOR AIR CONDITIONING APPARATUS

[75] Inventors: James E. Chorey; John Burch, both of Seattle, Wash.

[73] Assignee: Controlled Energy Systems Company, Seattle, Wash.

[21] Appl. No.: 889,630

[22] Filed: Mar. 24, 1978

[51] Int. Cl.[3] ..... F25D 17/02; G05D 23/00

[52] U.S. Cl. ..... 62/185; 62/201; 62/209; 62/229; 236/91 F

[58] Field of Search ..... 62/201, 202, 208, 209, 62/229, 185; 236/91 F

[56] References Cited

U.S. PATENT DOCUMENTS

| | | | |
|---|---|---|---|
| 3,204,423 | 9/1965 | Resh, Jr. | 62/212 X |
| 3,362,185 | 1/1968 | Harnish | 62/201 |
| 4,060,997 | 12/1977 | Shultz et al. | 62/185 X |
| 4,201,061 | 5/1980 | Hefferman | 62/201 X |

*Primary Examiner*—William E. Wayner
*Assistant Examiner*—Harry Tanner
*Attorney, Agent, or Firm*—Seed, Berry, Vernon & Baynham

[57] ABSTRACT

Modulating system for electrically or pneumatically controlled chillers in which a sensor senses the space condition, in a controlled environment or space. Output signals from an enthalpy sensor or other sensor representing the space condition are fed to chiller modulator electronic controls and thence to the chiller modulator interface controls, be they electric or pneumatic. The sensor monitors the conditions in or returning from the controlled space or environment. By measuring both humidity and temperature, the enthalpy sensor generates an effective temperature or comfort level. The input signal from the sensor is compared to an operator adjustable set-point. If the measured condition is less than the set-point, an error signal is generated which is proportional to the difference multiplied by an operator-set sensitivity control. The modulator interface control converts the error signal into a physical offset either applied in series with the chiller's own sensor, or is used to reset the set-point of the chiller control system. In the case of a chiller with a negative temperature coefficient resistance sensor, an appropriate amount of resistance is added in series with the sensor. In the case of a chiller with a positive temperature coefficient resistance sensor and appropriate amount of resistance is subtracted in series with the sensor. If the chiller sensor is pneumatic, a bleed valve is opened to change pressure which resets the set-point of the pneumatic control system.

17 Claims, 11 Drawing Figures

ELECTRONIC MODULATING SYSTEM FOR AIR CONDITIONING APPARATUS

BACKGROUND OF THE INVENTION

The invention relates generally to the field of modulating the chiller controls for an air-conditioning system, and more specifically relates to a chiller modulator system by which the chilled water of the chiller may be raised under given conditions thus saving energy.

Air-conditioning equipment manufacturers design their machinery to the requirements of a new building, that is the so-called "worst day" conditions. For example, a building in a hot climate must be maintained at 75° F. temperature and 50% relative humidity condition inside even though the outside conditions may be 95° F. and 75% relative humidity. In order to establish the desired conditions inside the building, the chilled water may be maintained at perhaps 42° F. leaving the chiller. In general, the controls of the chiller are set to output a constant leaving chilled water temperature. Accordingly, it will be appreciated that energy is being wasted because space conditions may be cooler than needed. On days in which the demands on the chiller are moderate, it is possible to maintain a comfort level in the space with a higher temperature of the chilled water leaving the chiller. Obviously, it is not practical for an operator to be constantly resetting the chiller controls to affect energy savings to maintain a comfort level or zone within the space. The heretofore known prior art does not provide automatic monitoring of the conditions in the controlled space and does not automatically adjust the leaving chilled water temperature requirements of the chillers depending upon conditions in the controlled space.

Among the prior art which is of interest only with respect to the instant invention are the following U.S. patents. They are: U.S. Pat. Nos. 4,024,725; 4,018,584; 3,913,344; 3,834,617; and 3,738,609. None of the cited patents is particularly pertinent to the subject matter of this invention.

SUMMARY OF THE INVENTION

A typical air conditioning system will be provided with a chiller or chillers usually either electronically or pneumatically controlled. The chillers include their own leaving chilled water sensors, controls, auxiliary pump equipment and automatic start circuits. The invention provides a space condition measuring sensor for the controlled space and inputs a signal into the modulator system of the invention. The signals are fed to the modulator electronics and from there to the modulator interfaces for either the electric or pneumatic chiller machinery. An automatic start/stop function is provided which uses the output information, that is the differential voltage output from the chiller modulator electronics to decide whether or not to start the chillers. The sensor is placed in an appropriate location for the space to be monitored and is connected to a control designed to offset the leaving chilled water temperature of the chiller used in air-conditioning systems when conditions in the monitored space permit. The purpose is to raise the chilled water temperature when less than maximum cooling is required thus improving the system's efficiency and reducing energy consumption.

Accordingly, it is among the features, objects and advantages of the present invention to provide a chiller modulating system which does not modify the chiller's internal configuration. The chillers are controlled from outside and the system is compatible with the functions designed and installed into the chillers whether they are electrically or pneumatically controlled. The system of this invention cannot lower the chilled water temperature below the normal operating point. The chiller's own safety circuits are not disabled or bypassed. Thus, failure of the modulating system of this invention should cause no damage to the chiller machinery. The instant invention cannot have any affect on the chiller machinery or the controls except to reduce the electrical loading thereon. The system interfaces with the chiller leaving chilled water sensor system only so that installation is singularly simple and inexpensive. The system provides a control point from which the entire space such as a building may be monitored and controlled. It enables the chillers to be controlled by selection of the most representative part of the controlled area, or the most critical zone, typically the warmest section of the controlled space. The system provides continuous monitoring and correction to maintain constant space comfort conditions. The system monitors the space condition and it compares it to a set-point the operator dials into the modulator controls and the system compares the two signals. Whenever the space conditions are warmer than the set point no correction signal is provided and the chillers function as they were calibrated to operate. When the controlled space condition is below the set-point an error signal is provided to the modulator's interfacing controls. The error signal will cause a false signal to be given to the machine which will in turn cause the chilled water temperature to raise in proportion to the difference signal thus unloading the machine. By increasing the chilled water temperature less electricity is required to run the chillers so that in effect a savings is realized in the electrical consumption of the chiller. Again, the system monitors the space conditions and resets the water temperature of the chiller on a continuing basis without any assistance from human hands. Thus there has been accomplished a fully automated system for controlling the chilled water temperature.

DESCRIPTION OF PREFERRED EMBODIMENT

Figure 1:
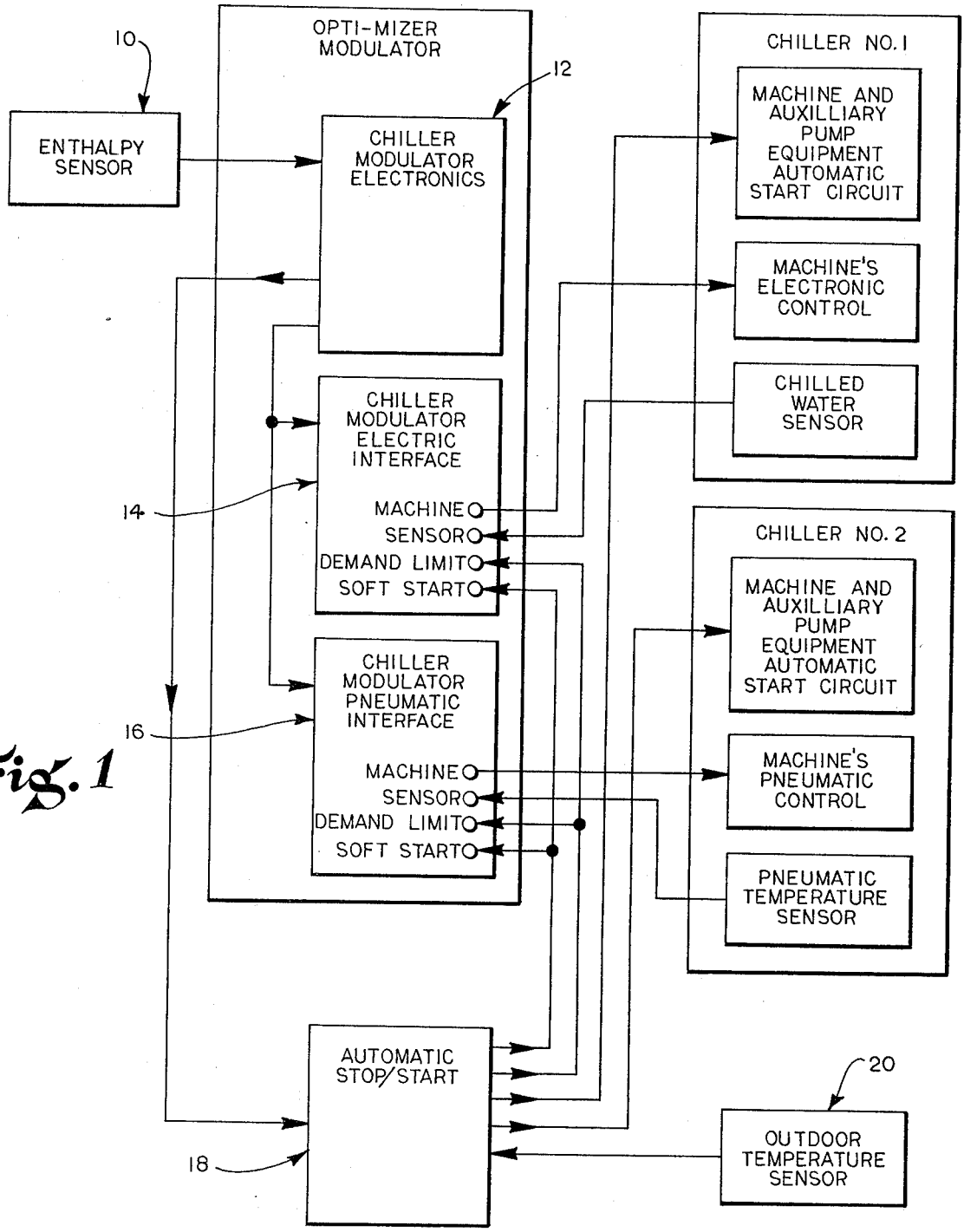
FIG. 1 is an overall block diagram of the entire system showing its major components with respect to chiller machinery.

Referring now to the drawings and in particular to FIG. 1, there is shown an overall block diagram of the system. The input of a sensor, with an enthalpy sensor shown, generally designated by the number 10, has its input signal directed to the chiller modulator electronics generally designated by the number 12. The space condition sensor is not strictly limited to an enthalpy measurement, and return water temperature might be used, for example. In turn the chiller modulator electronics input signals to the chiller modulator interfaces, the electrical one being designated by the number 14 and the pneumatic interface being designated by the number 16. Typically, the system would consist of either pneumatic or electronic rather than a mixture of both. Chiller number 1 thus is indicated as an electronically controlled machine and chiller machine number 2 is indicated as pneumatically controlled for the purposes of illustration of this invention. Additionally, there is an automatic start/stop function embodied in box 18. Box 18 is a group of modules in a conventional system using the output information consisting of the differential voltage output from the chiller modulator electronics 12 to decide whether or not to start the chillers. The automatic start/stop 18 also receives input information from the outdoor temperature sensor 20 and stops the chiller depending on outdoor conditions. It also controls the auxiliary equipment of the machine and is responsible for starting the chiller machines. The automatic start/stop 18 does not do any of the resetting of the chilled water temperature. As will be seen hereinafter, resetting of the chilled water temperature is a funciton of either the electric or the pneumatic interfaces 14 or 16.

Figure 2:
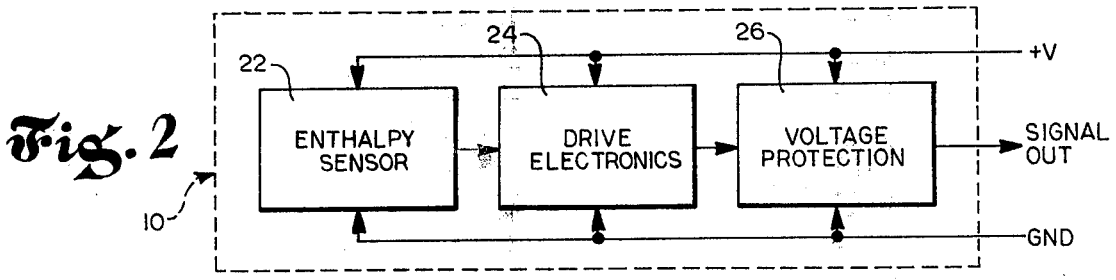
FIG. 2 is a block diagram of an enthalpy sensor which may be used in the system.
Figure 4:
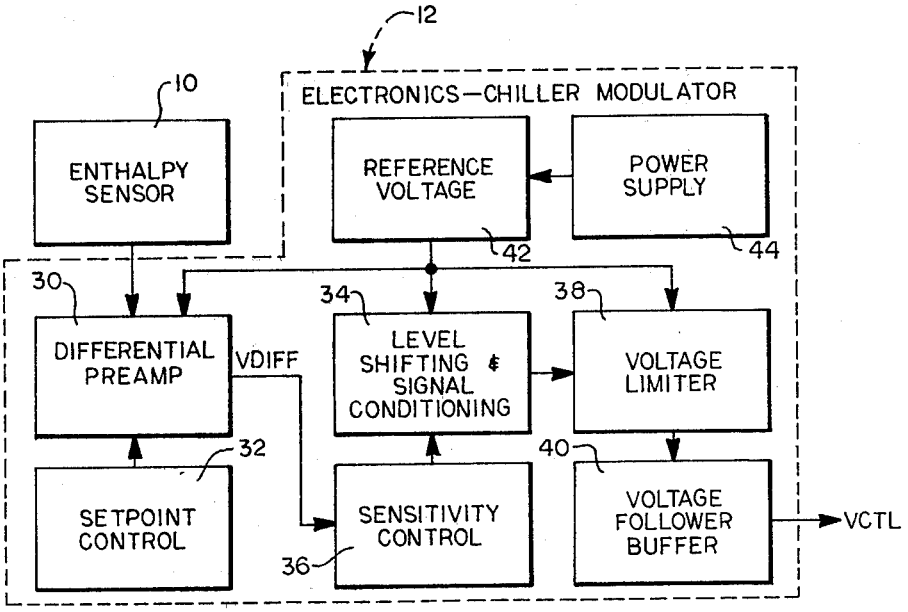
FIG. 4 is a block diagram of the chiller modulator electronics.

FIG. 2 of the drawings shows the enthalpy sensor 10 which has basically three sections. The first portion is the sensor 22 which provides a measurement of real temperature or more accurately dry bulb temperature and it also makes a relative humidity measurement of the air condition in the space being monitored. The temperature and humidity measurements are fed to the driver electronics 24 which is basically a voltage follower to provide a low output impedance for driving the remainder of the system. The voltage protection section 26 keeps transient signals from coming in to create electrical disturbances or damage. The output signal of the sensor is fed to the chiller modulator electronics 12 as shown in FIG. 4. Input signals to the sensor are power and a common ground from the modulator electronics.

Figure 8:
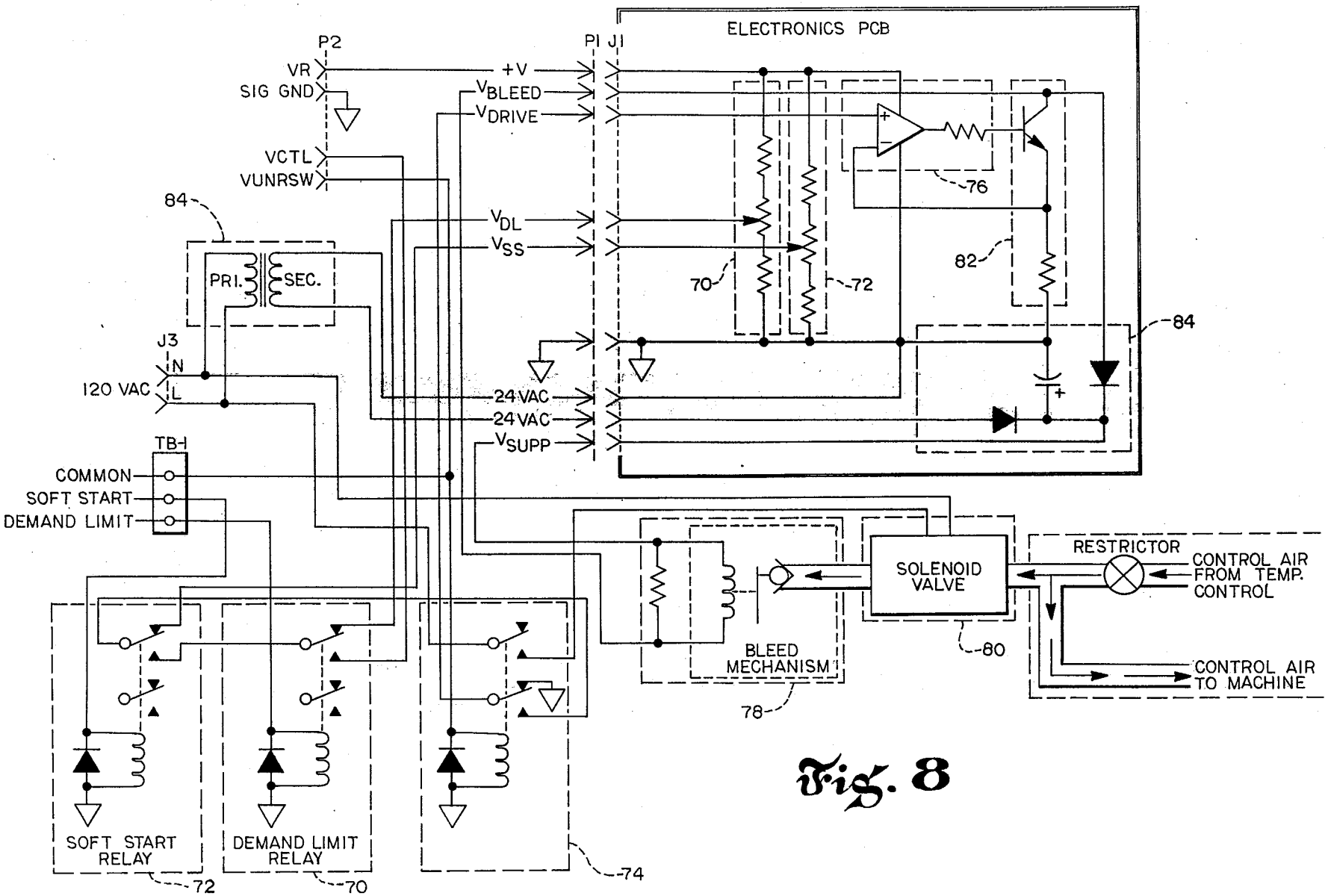
FIG. 8 is an electrical schematic of the block diagram of FIG. 3.

As can be seen in FIG. 4, the chiller modulator electronics receive the sensor signal to drive the differential preamplifier 30 which develops a differential signal which is a function of the set-point control 32 and the sensor input. This differential signal is then fed to the sensitivity control 36 which is provided to vary the gain of the system. The sensitivity control 36 output is then fed to the level shifting and signal conditioning circuits 34 which translate the signal to provide it in a form compatible with the voltage limiter 38 input signal range. The voltage limiter 38 provides an output voltage range which has a lower voltage limit and scales the control range of the interfaces. This will prevent or help to prevent over-running the motor or driving the bleed valve too far open. The voltage buffer or follower 40 provides a low output impedance from the circuit and provides buffering for additional noise immunity. The reference voltage circuit 42 provides a stable five volt reference for use by the differential preamplifier and the level shifting and signal conditioning circuits as well as the voltage limiter circuit means. The power supply 44 provides the basic power for all circuits including the sensor and the interfaces. The power supply 44 provides a regulated voltage for all of the signal conditioning and sensor electronics and the voltage for driving the motors and the relays. The output of the voltage follower 40 is the signal referred to as VCTL in FIG. 4, FIG. 8 and FIG. 9, and said VCTL signal goes either to an electronic interface or a pneumatic interface depending on the nature of the chiller machine.

Figure 5:
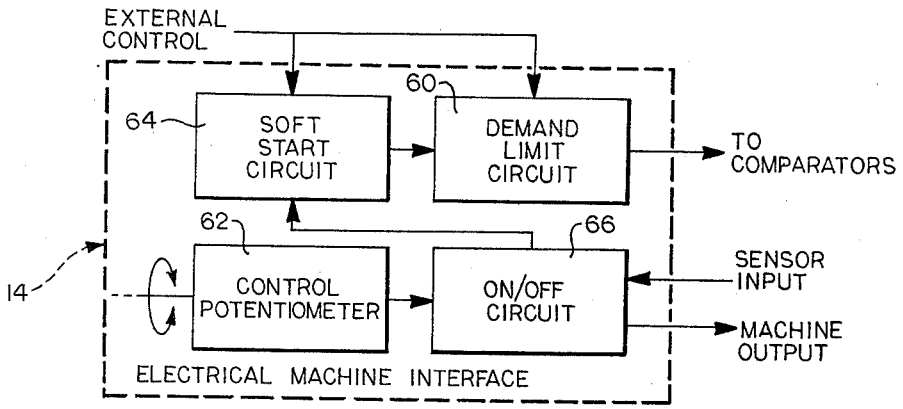
FIG. 5 is a block diagram of the modulator's electrical interface for electrically controlled chillers.
Figure 6:
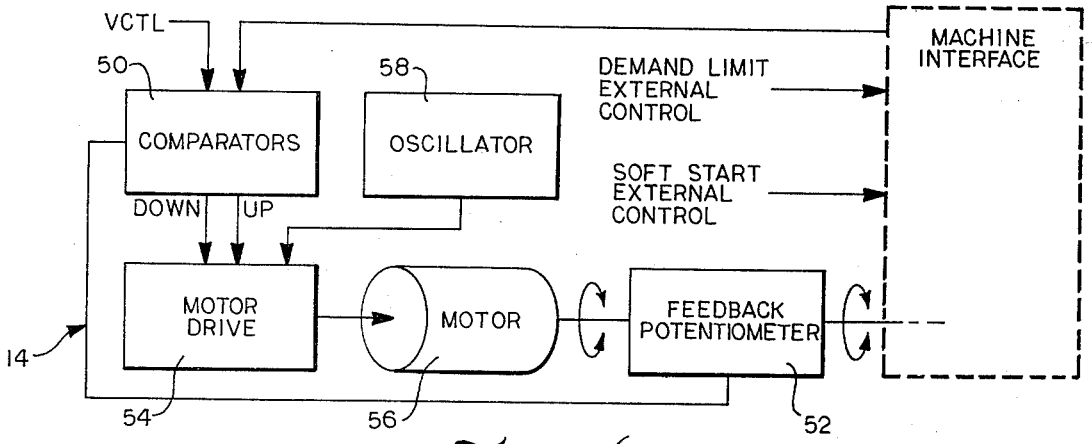
FIG. 6 shows a motor drive system for both an electrical and pneumatic machine interface.
Figure 9:
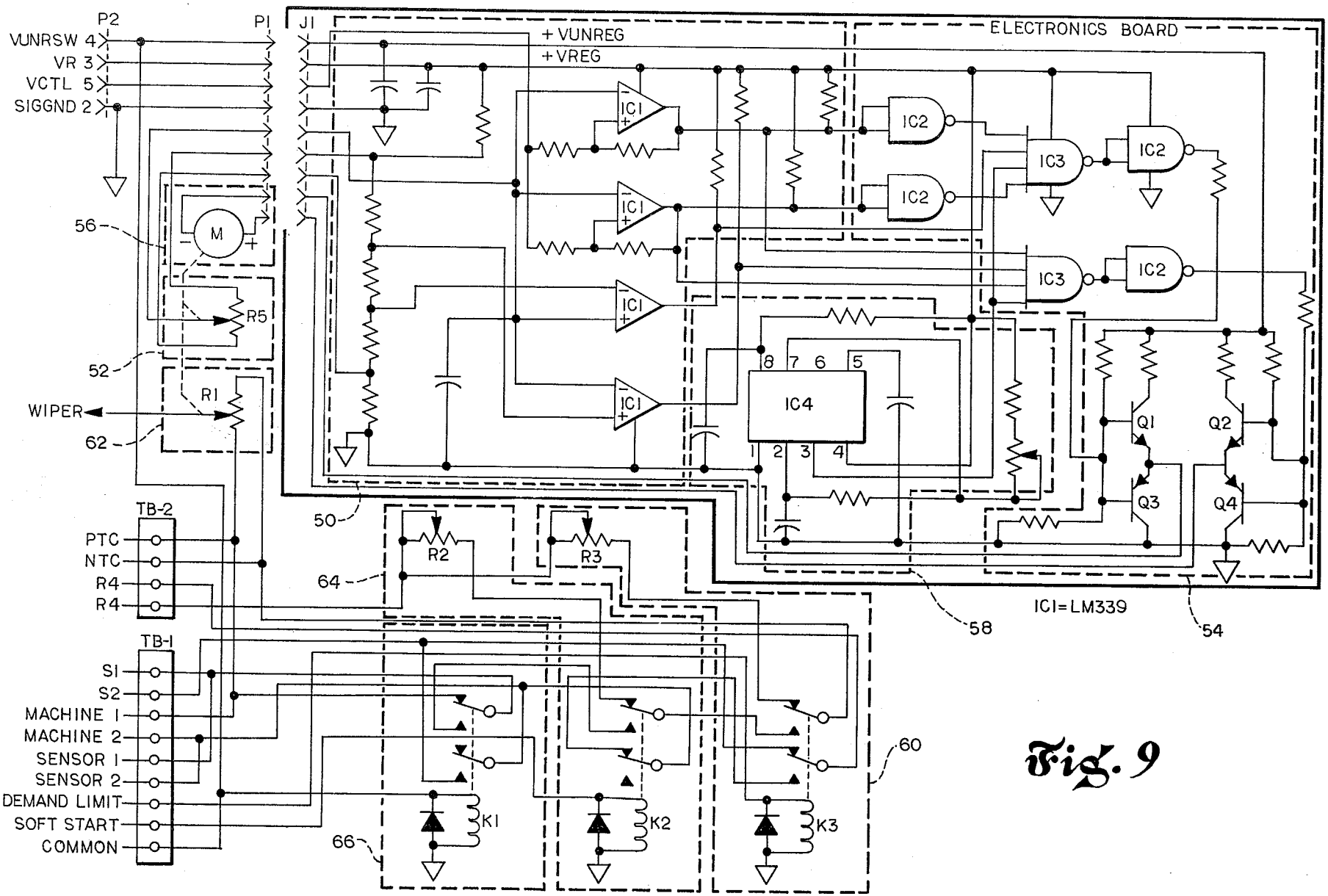
FIG. 9 is an electrical schematic of the block diagram of FIGS. 5 and 6.

FIGS. 5 and 6 together with the schematic of FIG. 9 show an electrical interface in the modulator of this system. The voltage control VCTL input from the chiller modulator electronics 12 to the electrical interface 14 is directed to comparators 50. The comparators determine whether or not the motor driven feedback potentiometer 52 is in agreement with the input signal. If it is not in agreement with the input signal then the comparators 50 will cause the motor drive 54 to move either up or down so as to align the potentiometer with the input voltage. This, of course, is a typical servo-feedback loop type system. The oscillator circuit 58 provides pulses to the motor drive circuit 54 to prevent continuous running. The oscillator slows down the system somewhat and is used mostly as a device to enable the system to make small incremental changes. The motor drive electronics 54 provides not only the up/down command for the motor 56 but also act as power buffering circuits and to amplify the drive signal so that the motor has sufficient power to perform its function. In addition to the feedback potentiometer attachment to the motor, there is also provided a control potentiometer 62 which is designed to be compatible with the sensor of a particular chiller machine. This is the device which provides an error signal to the chiller machine at the sensor input of the chiller machine to cause it to reduce its load. The demand limit circuit 60, the soft start circuit 64, and the on/off relay circuit 66 merely provide signals which can be switched in for the chiller machine sensor. This enables the sensor into a demand limit condition or a soft start condition. If the electrical interface is in the off mode it will allow the chiller machine sensor to input directly to the machine rather than through the electrical interface potentiometer system of the electronics of this invention.

Figure 7:
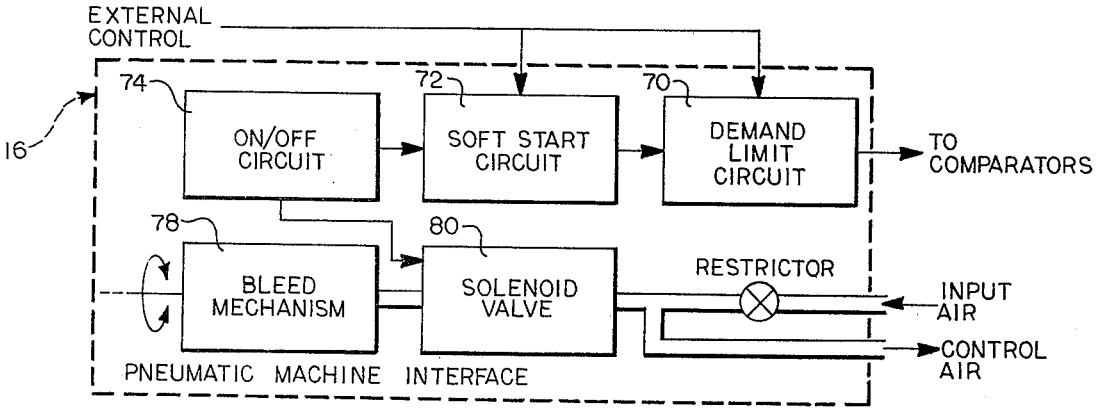
FIG. 7 is a block diagram showing a motor driven pneumatic machine interface mechanism.

FIGS. 6 and 7 show a motor driven pneumatic interface which may be substituted for the electrical interface described above. The operation is essentially the same as the above described electric interface of FIGS. 5 and 6. The major difference lies in the fact that the motor 56 drives a bleed mechanism 78 of FIG. 7 instead of a control potentiometer 62 of FIG. 5. The on/off circuits 66 and 74, demand limit circuits 60 and 70, and the soft-start circuits 64 and 72 of both FIGS. 5 and 7 perform the same function and are fed to the comparators 50 of FIG. 6. The solenoid valve 80 of FIG. 7 is a safety device and performs the same function as described below in conjunction with the operation of the pneumatic interface of FIGS. 3 and 10.

Figure 3:
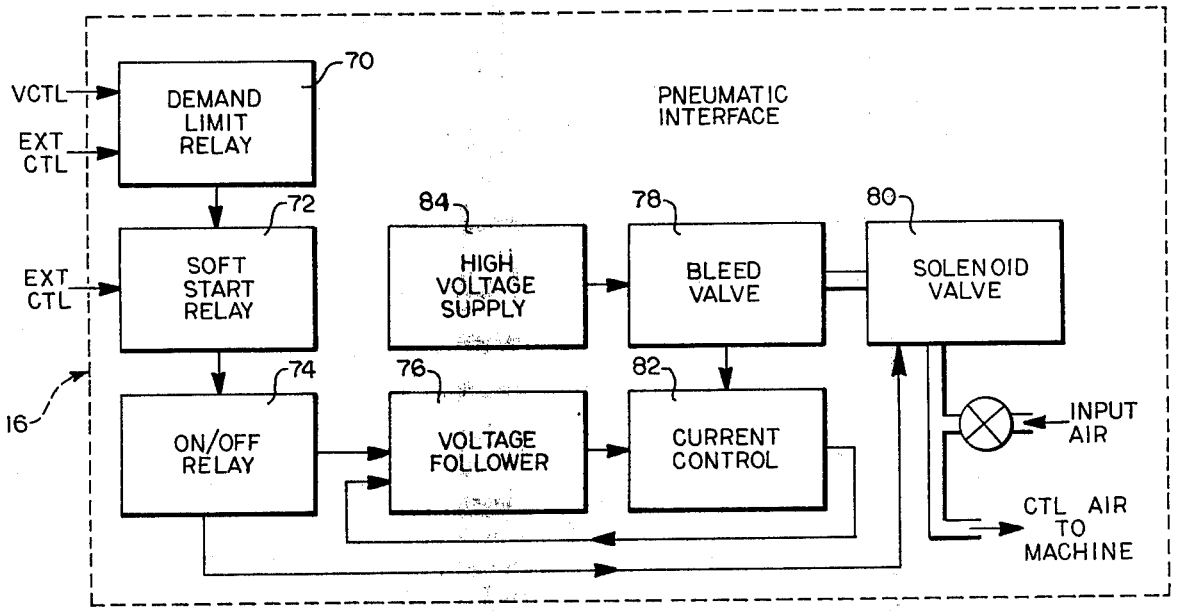
FIG. 3 is a block diagram of the electronics and pneumatics for a pneumatic interface for the system.
Figure 10:
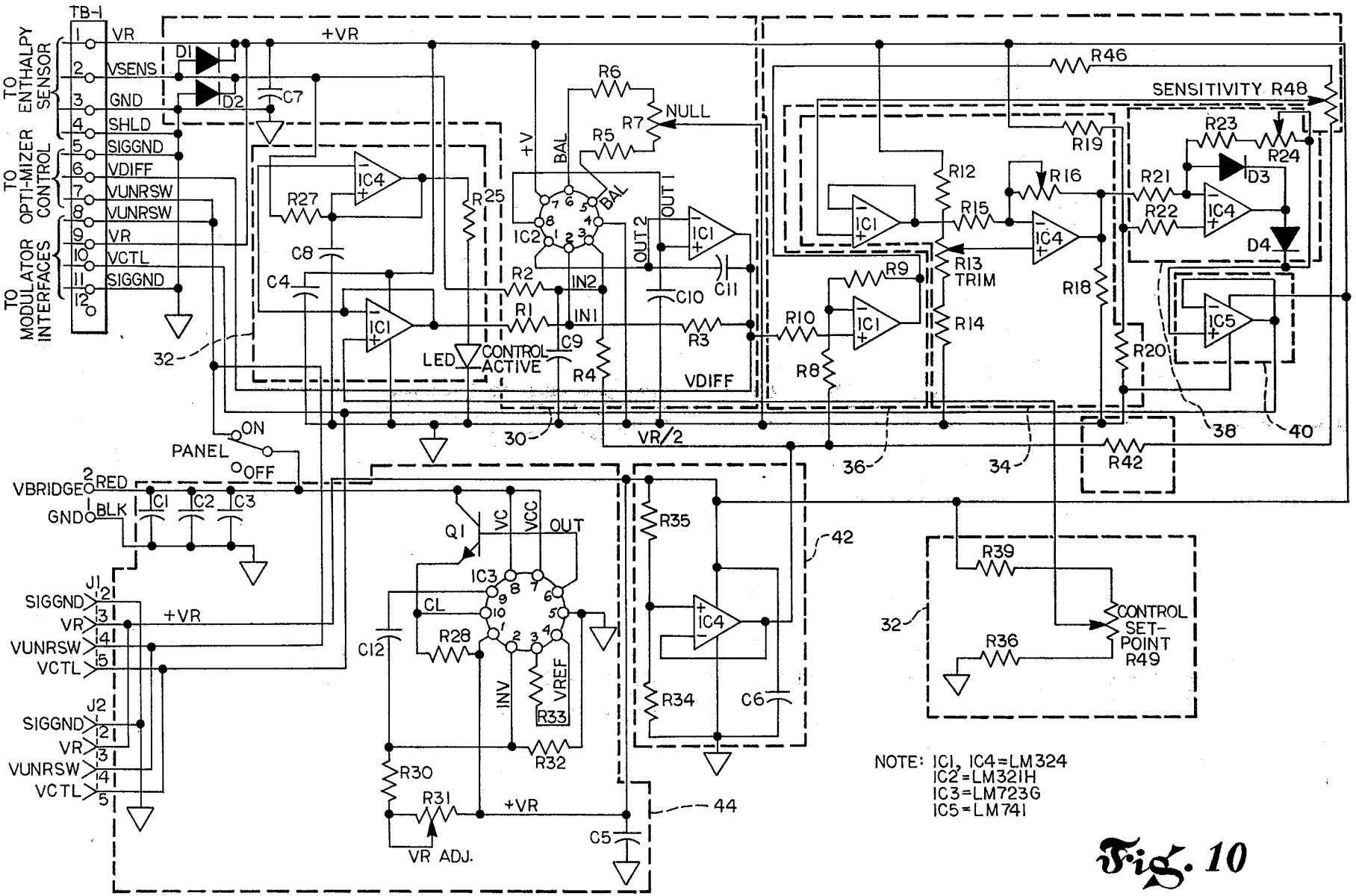
FIG. 10 is an electrical schematic of the chiller modulator electronics of FIG. 4.
Figure 11:
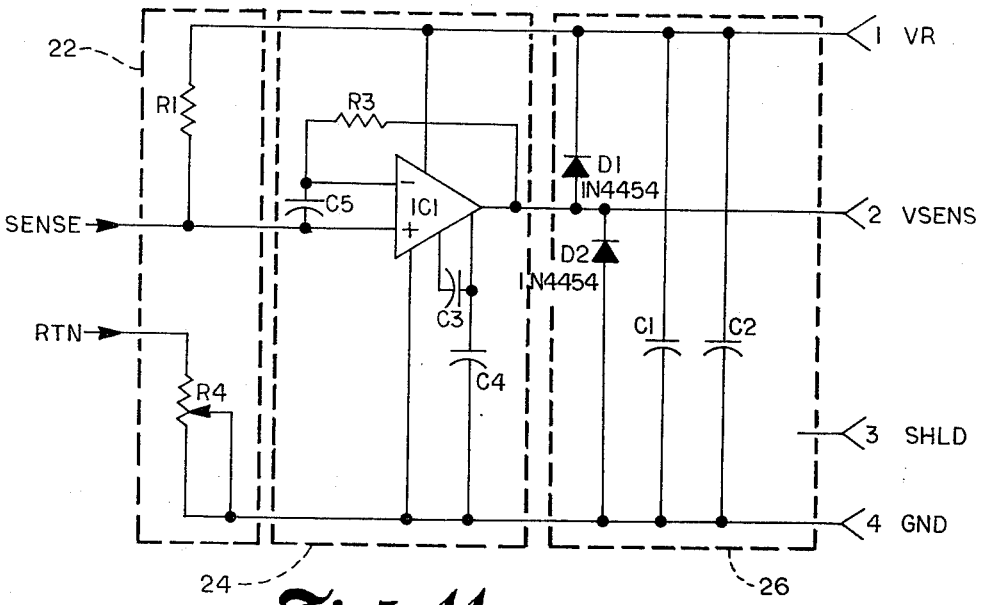
FIG. 11 is an electrical schematic for the block diagram of FIG. 2.

FIGS. 3 and 10, showing a pneumatic interface, may replace or be substituted for the electrical interface above described. Again and for the pneumatic system the input signal is once again the control voltage VCTL from the chiller modulator electronics of FIG. 4. The input signal is directed to the demand limit relay 70, through the soft start relay 72 and finally through the on/off relay 74. In circits 70, 72 or 74, the control voltage is selected or the soft start or the demand limit voltage is selected as the input to the voltage follower 76. If the system is off, the solenoid valve 80 is closed thus not allowing any action by the bleed valve 78 in the event that the bleed valve should fail. Voltage follower 76 then has a signal output to a current control circuit 82 inasmuch as the bleed valve mechanism 78 is basically a current sensitive device. Current through the bleed valve 78 is varied by the current control 82 and that in turn is controlled by the voltage follower 76. Because the bleed valve 78 is a higher voltage device, the high voltage supply 84 is included to provide the necessary drive levels. The solenoid valve 80 is only open when the on/off relay 74 is in the on condition. Thus there is provided safety so that should any component or circuit fail or should the operator not wish to use the electrical modulator electronics for some reason, he can completely bypass the entire modulator system.

In order to reset the chilled water temperature the input signal from the sensor, which is representative of the space conditions for the controlled environment such as in a building, is compared to a set point defined by the set point control 32 of the chiller modulator electronics. The two signals are compared and whenever the building conditions are warmer than the set-point defined by the set-point control 32 no correction signal is provided to the chiller machines. Thus the electronics of the modulator system will have no affect on the chiller machine operations allowing it to operate as designed. In this way, the chilled water temperature will be held to machine output specifications until the building is comfortable. When the space conditions monitored by the sensor are below the set point set on the chiller modulator electronics by the set point control 32 then an error signal is delivered to the electrical or pneumatic interface. The error signal will then cause a false signal to be given to the machine which will enable the chilled water temperature to be raised a predetermined amount. The amount that the water temperature rises is a function of the difference between the space conditions as monitored and the set point multiplied by sensitivity setting of sensitivity control 36. The sensitivity knob setting being multiplied by the difference between the space conditions and the set point results in a signal which is then translated into an offset signal to be provided to the machine sensors via the interfaces. The sensor circuit with the false output or correction signal causes the machine to unload so that the chilled water temperature will increase. For instance, a typical system installation involves choosing the temperature set point and the sensitivity setting. Thus it will be understood that a 4° increase in the leaving chilled water temperature for a 2° differential between the set-point and the space condition will require a sensitivity setting of 2.0. Accordingly, when space conditions are 2° below the set point, a 4° increase in leaving chilled water temperature is implemented. Obviously, increasing the chilled water temperature makes the building warmer so that as the building temperature moves closer to the set-point the offset or correction factor supplied to the sensor of the machine is made smaller so that eventually an equilibrium point will be reached. In this way, the offset of the machines is at a minimum and the building conditions will be slightly below or very close to the set-point and the system is stable. Thus and as explained above, the water temperature of the chiller machine is increased and by such increase in water temperature the chiller machine requires less electricity which effects a savings in the energy consumption of the chiller machine or machines.

What is claimed is:

1. A control modulating system for a chiller machine in which said chiller machine includes a chiller sensor means providing a chilled water temperature signal indicative of the temperature of chilled water leaving said chiller machine, said chiller sensor means being connected to said chiller machine through chiller sensor leads, said control modulating system comprising:

modulator sensor means located within the space to be controlled to detect and monitor at least the temperature conditions therein:

modulator controls for receiving input signals from said modulator sensor means and including an operator regulated set-point control for determining the desired conditions of the space to be controlled, said modulator controls also including means for generating a differential output signal which is indicative of the difference between said input signal and said set-point, said modulator controls further including an operator regulated sensitivity control for providing a multiplier factor for said differential output signal for generating an error signal; and modulator interface circuit means for receiving said error signal from said modulator controls and for providing an offset signal to the chiller sensor leads to modify said chilled water temperature signal, thereby causing the chilled water temperature to rise a predetermined amount.

2. The control modulating system according to claim 1 and in which said modulator sensor means is an enthalpy sensor.

3. The control modulating system according to claim 2 and in which said modulator controls include circuit means for comparing said set point control to said enthalpy sensor input signal so that if the space conditions are higher than the set point said modulator control system remains inoperative and if below the set-point said system becomes operative.

4. The control modulating system according to claim 3 and in which said means for generating a differential output signal is a differential preamplifier circuit means.

5. The control modulating system according to claim 4 and in which said interface circuit means is an electronic interface.

6. The control modulating system according to claim 4 and in which said interface circuit means is a pneumatic interface.

7. The control modulating system according to claim 2 wherein said chiller sensor means has a resistance which varies in accordance with the temperature of chilled water leaving said chiller machine, and wherein said interface circuit includes a resistance element connected to said chiller sensor means having a resistance which is controlled by said error signal such that the resistance across said chiller sensor leads is the resistance of said chiller sensor means as modified by the resistance of said resistance element.

8. A control modulating system for a chiller machine in which said chiller machine includes a chiller sensor means providing a chilled water temperature signal indicative of the temperature of chilled water leaving said chiller machine, said chiller sensor means being connected to said chiller machine through chiller sensor leads, said control modulating system comprising:

modulator sensor means located within the space to be controlled to detect and monitor temperature and humidity conditions therein;

modulator controls for receiving input signals from said modulator sensor means and including (1) an operator regulated set point control for determining the desired conditions of the space to be controlled, (2) circuit means for comparing said set-point control to said modulator sensor input signal so that if the space conditions are higher than the set-point said modulator control system remains inoperative and if below the set point said system becomes operative, (3) an operator regulated sensitivity control for providing a multiplier factor for the difference between said sensor input signal and said set point for generating an error signal when said system is operative; and modulator interface circuit means for receiving said error signal from said modulator controls and for providing an offset signal to the chiller sensor leads to modify said chilled water temperature signal, thereby causing the chilled water temperature to rise a predetermined amount.

9. The control modulating system according to claim 8 and in which said modulator sensor means is an enthalpy sensor.

10. The control modulating system according to claim 9 and in which said modulator controls are provided with a differential output signal circuit means to generate a differential signal which is a function of said set-point control and said enthalpy sensor input.

11. The control modulating system according to claim 10 and in which said interface circuit means is an electronic interface.

12. The control modulating system according to claim 10 and in which said interface circuit means is a pneumatic interface.

13. The control modulating system according to claim 8 wherein said chiller sensor means has a resistance which varies in accordance with the temperature of chilled water leaving said chiller machine, and wherein said interface circuit includes a resistance element connected to said chiller sensor means having a resistance which is controlled by said error signal such that the resistance across said chiller sensor leads is the resistance of said chiller sensor means as modified by the resistance of said resistance element.

14. A control modulating system for a chiller machine in which said chiller machine includes a chiller sensor means providing a chilled water temperature signal indicative of the temperature of chilled water leaving said chiller machine, said chiller sensor means being connected to said chiller machine through chiller sensor leads, said control modulating system comprising:

modulator sensor means located within the space to be controlled to detect and monitor the conditions of returning chilled water to said chiller machine;

modulator controls for receiving input signals from said modulator sensor means and including an operator regulated set-point control for determining the desired conditions of the space to be controlled, said modulator controls also including means for generating a differential output signal which is indicative of the difference between said input signal and said set-point, said modulator controls further including an operator regulated sensitivity control for providing a multiplier factor for said differential output signal for generating an error signal; and modulator interface circuit means for receiving said error signal from said modulator controls and for providing an offset signal to the chiller sensor leads to modify said chilled water temperature signal, thereby causing the chilled water temperature to rise a predetermined amount.

15. The control modulating system according to claim 14 wherein said chiller sensor means has a resistance which varies in accordance with the temperature of chilled water leaving said chiller machine, and wherein said interface circuit includes a resistance element connected to said chiller sensor means having a resistance which is controlled by said error signal such that the resistance across said chiller sensor leads is the resistance of said chiller sensor means as modified by the resistance of said resistance element.

16. A control modulating system for a chiller machine in which said chiller machine includes a chiller sensor means providing a chilled water temperature signal indicative of the temperature of chilled water leaving said chiller machine, said chiller sensor means being connected to said chiller machine through chiller sensor leads, said control modulating system comprising:

modulator sensor means located within the space to be controlled to detect and monitor the temperature of air returning from said space to be controlled to a portion of said chiller machine;

modulator controls for receiving input signals from said modulator sensor means and including an operator regulated set point control for determining the desired conditions of the space to be controlled, said modulator controls also including means for generating a differential output signal which is indicative of the difference between said input signal and said set point, said modulator controls further including an operator regulated sensitivity control for providing a multiplier factor for said differential output signal for generating an error signal; and modulator interface circuit means for receiving said error signal from said modulator controls and for providing an offset signal to the chiller sensor leads to modify said chilled water temperature signal, thereby causing the chilled water temperature to rise a predetermined amount.

17. The control modulating system according to claim 16 wherein said chiller sensor means has a resistance which varies in accordance with the temperature of chilled water leaving said chiller machine, and wherein said interface circuit includes a resistance element connected to said chiller sensor means having a resistance which is controlled by said error signal such that the resistance across said chiller sensor leads is the resistance of said chiller sensor means as modified by the resistance of said resistance element.

* * * * *